US010149361B1

(12) United States Patent
Mignoli

(10) Patent No.: US 10,149,361 B1
(45) Date of Patent: Dec. 4, 2018

(54) DRIVER FOR LIGHT EMITTING DEVICES USING SEQUENTIAL COUPLING

(71) Applicant: Infineon Technologies AG, Neubiberg (DE)

(72) Inventor: Franco Mignoli, Verona (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/608,227

(22) Filed: May 30, 2017

(51) Int. Cl.

| | |
|---|---|
| ***G09G 3/20*** | (2006.01) |
| ***H05B 33/08*** | (2006.01) |
| ***G09G 3/3283*** | (2016.01) |
| ***G09G 3/3241*** | (2016.01) |

(52) U.S. Cl.
CPC ..... *H05B 33/0848* (2013.01); *G09G 3/3241* (2013.01); *G09G 3/3283* (2013.01); *H05B 33/0815* (2013.01); *H05B 33/0824* (2013.01)

(58) Field of Classification Search
CPC ..... H05B 33/0848; H05B 33/0815; H05B 33/0824
See application file for complete search history.

(56) References Cited

U.S. PATENT DOCUMENTS

2007/0182671 A1* 8/2007 Nathan ..... G09G 3/3241 345/76
2010/0073265 A1* 3/2010 Hirai ..... G09G 3/3241 345/55

OTHER PUBLICATIONS

Jafarabadiashtiani, "Pixel Circuits and Driving Schemes for Active-Matrix Organic Light-Emitting Diode Displays," Thesis presented to the University of Waterloo, 2007, accessed on Mar. 17, 2017, 188 pp.

* cited by examiner

*Primary Examiner* — Dedei K Hammond
*Assistant Examiner* — Raymond R Chai
(74) *Attorney, Agent, or Firm* — Shumaker & Sieffert, P.A.

(57) ABSTRACT

A method includes sequentially coupling, by a switching module of a circuit, each cell of a plurality of cells to a driver module. Each cell of the plurality of cells includes a light emitting diode (LED) configured to activate based on a control voltage at a respective cell of the plurality of cells. The method includes driving, by the driver module, the control voltage of the respective cell based on a reference current when the switching module sequentially couples the respective cell to the driver module.

16 Claims, 10 Drawing Sheets

DRIVER FOR LIGHT EMITTING DEVICES USING SEQUENTIAL COUPLING

TECHNICAL FIELD

This disclosure relates to light emitting devices, and more particular, to techniques and circuits associated with light emitting diodes (LEDs).

BACKGROUND

Light emitting devices, for instance, light emitting diodes (LEDs), may be operated by a driver circuit. The driver circuit may control a light intensity output by an LED by varying an average amount of current flowing through the LED. For example, the driver circuit may increase a duty cycle of a current output to an LED to increase a light intensity output by the LED. Similarly, the driver circuit may decrease the duty cycle of the current output to an LED to decrease the light intensity output by the LED.

SUMMARY

The disclosure describes techniques, devices, and systems for driving light emitting devices. In some examples, a single driver module of a circuit may program multiple light emitting diodes (LEDs) of a set of LEDs (e.g., arranged in an LED matrix device). For example, a driver module may program a first LED for a desired duty cycle and LED current. In this example, after programming the first LED, a switching module may decouple the first LED from the driver module and couple the driver module to a second LED. Once the driver module is coupled to the second LED, the driver module may program the second LED for a desired duty cycle and LED current.

In an example, a method includes sequentially coupling, by a switching module of a circuit, each cell of the plurality of cells to a driver module. Each cell of the plurality of cells includes an LED configured to activate based on a control voltage at a respective cell. The method further includes driving, by the driver module, the control voltage of a respective cell of the plurality of cells based on a reference current when the switching module sequentially couples a respective cell of the plurality of cells to the driver module.

In another example, a circuit includes a driver module and a switching module. The driver module is configured to receive a reference current for a plurality of cells. Each cell of the plurality of cells includes an LED configured to activate based on a control voltage at a respective cell of the plurality of cells. The switching module is configured to sequentially couple each cell of the plurality of cells to the driver module. The driver module is further configured to drive a control voltage of a respective cell of the plurality of cells based on the reference current when the switching module sequentially couples a respective cell of the plurality of cells to the driver module.

In another example, a circuit includes an LED matrix device, a driver module, and a switching module. The LED matrix device includes at least a plurality of cells arranged in a column of the LED matrix device. Each cell of the plurality of cells comprising an LED is configured to activate based on a control voltage at a respective cell of the plurality of cells. The driver module is configured to receive a reference current for the plurality of cells. The switching module is configured to sequentially couple each cell of the plurality of cells to the driver module. The driver module is further configured to drive a control voltage of a respective cell of the plurality of cells based on the reference current when the switching module sequentially couples a respective cell of the plurality of cells to the driver module.

Details of these and other examples are set forth in the accompanying drawings and the description below. Other features, objects, and advantages will be apparent from the description and drawings, and from the claims.

DETAILED DESCRIPTION

In general, this disclosure is directed to techniques for permitting bulk light emitting diode (LED) cell programming. In some systems, each driver circuit may program a single LED for a desired duty cycle and LED current. For instance, each LED cell of an LED matrix device may include a driver circuit for programming only a respective LED cell of the LED matrix device. However, a number of connections to operate the LED matrix device increases as a number of LED cells of the LED matrix device increases. As such, LED matrix devices having a large number of LED cells (e.g., 1024 LED cells or more) may have complicated routing for connections to operate the LED matrix device.

In accordance with embodiments described herein, a switching module may couple a driver module to multiple LED cells to permit a single driver module to program multiple LED cells. For example, after the switching module couples the driver module to a first LED cell arranged in a column of LED cells of an LED matrix device, the driver module may program the first LED cell. Upon programming the first LED cell, the switching module may couple the driver module to a second LED cell arranged in the column. After the switching module couples the driver module to the second LED cell, the driver module may program the second LED cell. In this way, fewer components may be used to drive multiple LED cells. Moreover, in some instances, such LED matrix devices, may include over 1,000 LED cells (e.g., 1024) that are arranged for a high pixel density. As such, one or more techniques described herein may permit LED matrix devices to have a higher pixel density than LED matrix devices that include a driver for programming only one LED cell.

Figure 1:
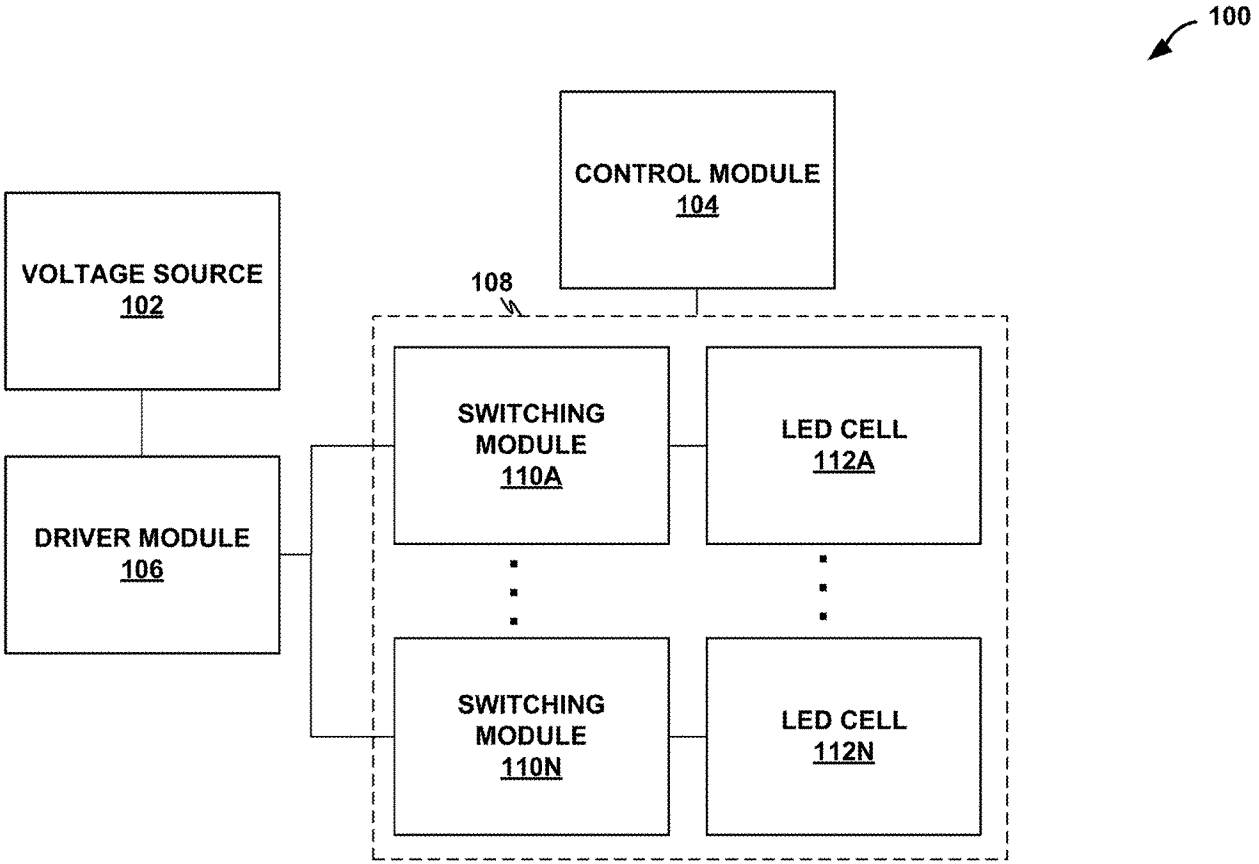
FIG. 1 is a block diagram illustrating an example system configured for bulk LED cell programming, in accordance with one or more techniques of this disclosure.

FIG. 1 is a block diagram illustrating an example system 100 configured for bulk LED cell programming, in accordance with one or more techniques of this disclosure. Although FIG. 1 illustrates system 100 as having separate and distinct components, shown as voltage source 102, control module 104, driver module 106, and an LED matrix device 108, two or more components may be combined. For instance, driver module 106 and LED matrix device 108 may be two individual components or may represent a combination of one or more components that provide the functionality of system 100 as described herein.

Voltage source 102 may be configured to provide electrical power to one or more other components of switching system 100. For instance, voltage source 102 may be configured to supply electrical power to LED cells 112. In some examples, voltage source 102 may be an output of a one or more battery cells. Examples of battery cells may include lead-acid, nickel metal hydride, lithium ion, or other types of battery cells. In some examples, voltage source 102 may be an output of a power converter, such as a rectifier. For instance, voltage source 102 may be a rectified ac output. Examples rectifiers may include, but are not limited to, single-phase rectifier (e.g., half wave, full wave, or the like), three-phase rectifier (e.g., half wave, full wave, bridge, or the like), or other types of rectifiers. In some examples, voltage source 102 may represent a connection to an electrical grid. For instance, voltage source 102 may be a rectified output of an AC to DC power converter receiving a VAC from an electrical grid (e.g., 120 VAC at 60 Hz, 230 VAC at 50 Hz, or another output from an electrical grid).

LED matrix device 108 may include any device that includes two or more LEDs. As shown, LED matrix device 108 may include switching modules 110A-110N (collectively, switching modules 110 or switching module 110) and LED cells 112A-112N (collectively, LED cells 112). Although the example of FIG. 1 illustrates LED matrix device 108 as including one column of LED cells 112, one or more techniques described herein may be used with an LED matrix device 108 that includes multiple columns of LED cells. For example, LED matrix device 108 may include 64 columns of LED cells, with each column including 64 LED cells. In examples where LED matrix device 108 include multiple columns of LED cells, each column of LED cells of LED matrix device 108 may be substantially similar to LED cells 112.

LED cells 112 may refer to two or more suitable semiconductor light sources. For example, LED cells 112 may each include an LED. In some examples, each of LED cells 112 include a p-n junction configured to emit light when activated. Each of LED cells 112 may include an LED configured to activate based on a control voltage. For example, an LED included in LED cell 112A may activate when a control voltage at LED cell 112A exceeds a threshold. In some examples, a parasitic capacitance and/or a capacitor may store the control voltage.

Control module 104 may be configured to generate a switching signal to operate switching modules 110. In some examples, control module 104 may include an analog circuit. In some examples, control module 104 may be a microcontroller on a single integrated circuit containing a processor core, memory, inputs, and outputs. For example, control module 104 may include one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. In some examples, control module 104 may be a combination of one or more analog components and one or more digital components.

Switching modules 110 may refer to two or more suitable switching devices. In some examples, each switching module of switching modules 110 may each include one or more switching elements. Examples of switching elements may include, but are not limited to, silicon controlled rectifier (SCR), a Field Effect Transistor (FET), and bipolar junction transistor (BJT). Examples of FETs may include, but are not limited to, junction field-effect transistor (JFET), metal-oxide-semiconductor FET (MOSFET), dual-gate MOSFET, insulated-gate bipolar transistor (IGBT), any other type of FET, or any combination of the same. Examples of MOSFETS may include, but are not limited to, PMOS, NMOS, DMOS, or any other type of MOSFET, or any combination of the same. Examples of BJTs may include, but are not limited to, PNP, NPN, heterojunction, or any other type of BJT, or any combination of the same. It should be understood that switching elements may include a high side switch or low side switch. Additionally, switching elements may be voltage-controlled and/or current-controlled. Examples of current-controlled switching elements may include, but are not limited to, gallium nitride (GaN) MOSFETs, BJTs, or other current-controlled elements.

Driver module 106 may be configured to drive a control voltage at LED cells 112. For example, driver module 106 may include an operational amplifier that drives the control voltage such that a voltage received at a first input of the operational amplifier equals a voltage received at a second input of the operational amplifier. For example, driver module 106 may "program" a control voltage. For example, at a beginning edge of an "on" portion of a duty cycle, driver module 106 may drive a control voltage at LED cell 112A to activate an LED at LED cell 112A. After driver module 106 drives the control voltage to activate the LED, a capacitance (e.g., parasitic, capacitor unit, etc.) maintains the control voltage to activate the LED at LED cell 112A during the "on" portion of the duty cycle. Then, at an end edge of the "on" portion of the duty cycle, driver module 106 may drive the control voltage at LED cell 112A to deactivate an LED at LED cell 112A. After driver module 106 drives the control voltage to deactivate the LED, the capacitance (e.g., parasitic, capacitor unit, etc.) maintains the control voltage to deactivate the LED at LED cell 112A during the "off" portion of the duty cycle.

Driver module 106 may optionally include a current source. For example, driver module 106 may include a current source that generates a reference current. Driver module 106 may drive a control voltage based on the reference current. For instance, driver module 106 may drive the control voltage at LED cell 112A such that a current at the LED cell 112A corresponds to the reference current when switching module 110A couples driver module 106 to LED cell 112A.

In operation, driver module 106 receives a reference current for LED cells 112. For example, driver module 106 receives a reference current generated by a current source. Each LED cell of LED cells 112 include an LED configured to activate based on a control voltage at a respective LED cell of LED cells 112. Switching modules 110 are configured to sequentially couple each LED cell of LED cells 112 to driver module 106. Driver module 106 is further configured to drive a control voltage of a respective cell of LED cells 112 based on the reference current when switching modules 110 sequentially couple a respective cell of LED cells 112 to driver module 106.

Figure 2:
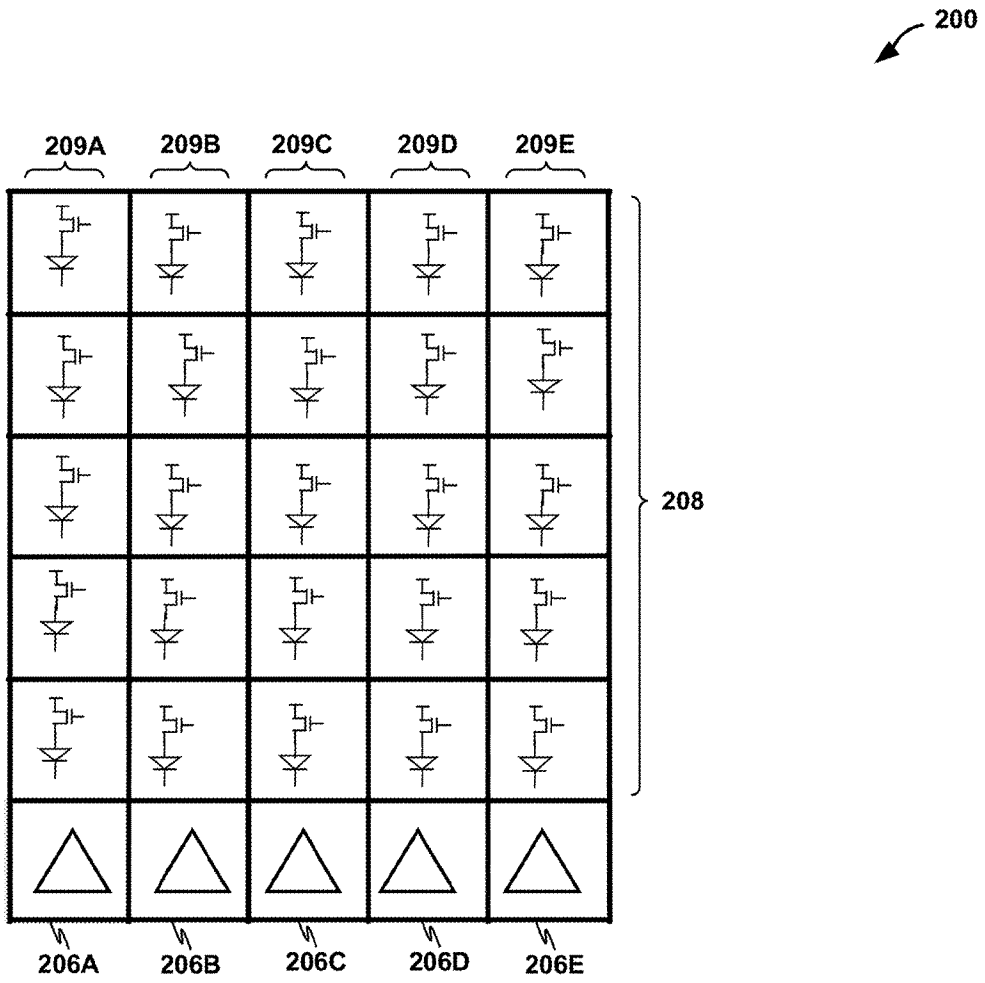
FIG. 2 is block diagram illustrating an example LED matrix device, in accordance with one or more techniques of this disclosure.

FIG. 2 is block diagram illustrating an example LED matrix device 208, in accordance with one or more techniques of this disclosure. As illustrated system 200 may include LED matrix device 208 that includes columns 209A-209E (collectively, columns 209). Although FIG. 2 illustrates five rows and five columns of LED cells, it should be understood that an LED matrix device may include different quantities of rows and/or columns. For example, LED matrix device may include 32 rows and 32 columns, 32 rows and 64 columns, 64 rows and 32 columns, 64 rows and 64 columns, or other quantities of rows and/or columns.

Although FIG. 1 illustrates 'n' number of LED cells, techniques described for the 'n' number of LED cells of FIG. 1 may apply for each column of columns 209. For example, each one of columns 209 may be configured to operate with one of driver modules 206A-206E (collectively, driver modules 206). For instance, a switching module (not shown) may sequentially switch each LED cell of column 209A to driver module 206A, a switching module (not shown) may sequentially switch each LED cell of column 209B to driver module 206B, and so on.

In some examples, each one of columns 209 may be associated with a reference current. For example, each one of columns 209 may be associated with a common reference current. For instance, columns 209 may each have a reference current of 52 microamperes (μA). In some examples, each one of columns 209 may be associated with a reference current that is different than reference currents assigned to other columns of columns 209. For instance, column 209A may have a reference current of 52 microamperes (μA) and column 209B may have a reference current of 66 microamperes (μA).

Driver modules 206 may be external to LED matrix device 208. For example, driver modules 206 may be formed on a substrate different from LED matrix device 208. In some examples, driver modules 206 and LED matrix device 208 may be within a common package. For instance, LED matrix device 208 may be a common package that includes a first substrate including switching modules 110 of FIG. 1, a second substrate including LED cells 112 of FIG. 1, and a third substrate including driver modules 206.

In systems that include a driver module and switching module for each LED cell, a number of top metal connections may increase similarly with a number of LED cells of an LED matrix device. For example, a top metal connection for one column of LEDs of an LED matrix device may include 8 pins for the column. For instance, a row enable pin, a data enable pin, a reset pin, a gate for NMOS current mirror pin, a logic supply pin, a ground pin, a charge pump supply pin, and an LED supply pin. Moreover, in systems that include a driver module for each LED cell of a column of 64 LED cells, the top metal connection for one column of LEDs of an LED matrix device may further include 64 reference current pins and 64 output LED pins. As such, each column of 64 LED cells may necessarily use 138 top metal connections.

In accordance with one or more techniques described herein, system 200 may be configured for bulk LED cell programming. For example, rather than including a driver module for each LED cell in LED matrix device 208, LED matrix device 208 includes a driver module 206 for each column of columns 209. For instance, driver module 206A may program each LED cell in column 209A, driver module 206B may program each LED cell in column 209B, driver module 206C may program each LED cell in column 209C, driver module 206D may program each LED cell in column 209D, and driver module 206E may program each LED cell in column 209E. As such, a number of top metal connections for one column of LEDs of LED matrix device 208 may be substantially less than systems that include a driver module for each LED cell. For example, a top metal connection for column 209A of LED matrix device 208 may include 10 pins for the column. For instance, a row enable pin, a data enable pin, a reset pin, a gate for NMOS current mirror pin, a logic supply pin, a ground pin, a charge pump supply pin, an LED supply pin, a voltage supply for the high side switching elements, and a reference current pin for column 209A. Moreover, in systems that include a driver module for each LED cell of a column of 64 LED cells, the top metal connection for one column of LEDs of an LED matrix device may further include 64 output LED pins. As such, each column of 64 LED cells may necessarily use 76 top metal connections which is substantially less than the 138 top metal connections that may be used in systems that include a driver module for each LED cell, thereby reducing a cost and complexity in a resulting device.

Additionally, in instances where each driver module includes a charge pump, LED matrix device 208 may have a reduced current consumption compared to systems that include a driver module for each LED cell because system 200 uses fewer driver modules than systems that include a driver module for each LED cell. For example, in systems that include a driver module for each LED cell of a column of 128 LED cells that has 64 rows of LED cells and a current consumption of 6 microamperes (6 μA), a total current may be 50 milliamperes (mA). However, system 200 may instead have a total current of 3 milliamperes (mA).

Figure 3:
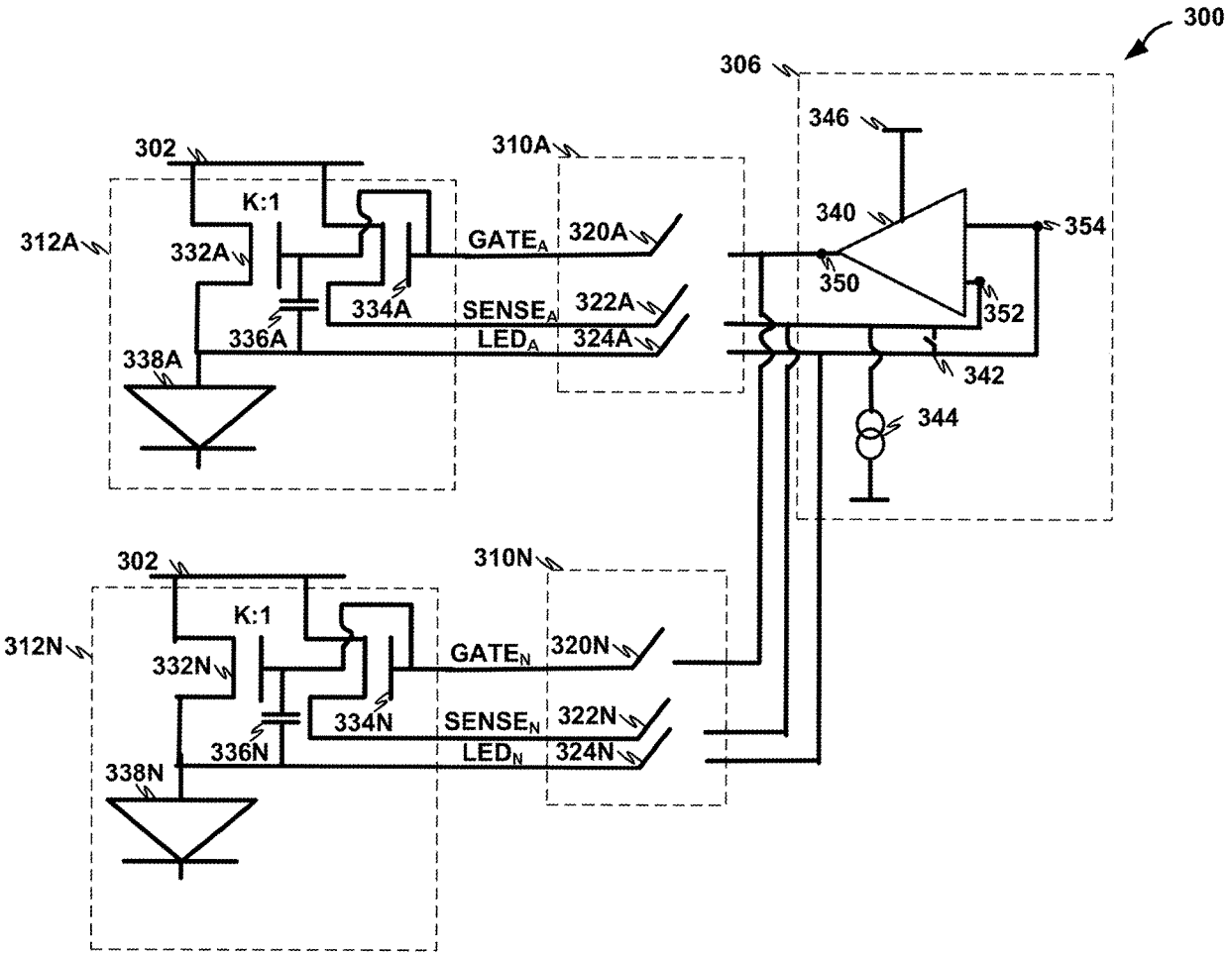
FIG. 3 is a circuit diagram illustrating a first example circuit for bulk LED cell programming, in accordance with one or more techniques of this disclosure.

FIG. 3 is a circuit diagram illustrating a first example circuit 300 for bulk LED cell programming, in accordance with one or more techniques of this disclosure. As illustrated, circuit 300 includes voltage source 302, driver module 306, switching modules 310A-310N (collectively, switching modules 310 or switching module 310), and LED cells 312A-312N (collectively, LED cells 312). Voltage source 302 may be an example of voltage source 102 of FIG. 1. Driver module 306 may be an example of driver module 106 of FIG. 1. LED cells 312 may be an example of LED cells 112 of FIG. 1. Switching modules 310A-310N may be an example of switching modules 110 of FIG. 1. Switching modules 310 and/or LED cells 312 may be included in an LED matrix device (not shown).

LED cell 312A may include switching element 332A, switching element 334A, capacitance 336A, and LED 338A. Although shown as a single package, it should be understood that components of LED cells 312 may be formed on different substrates. For example, LED 338A may be formed on a substrate that is different than a substrate that includes switching element 332A, switching element 334A, capacitance 336A. As discussed further below, LED cell 312A is configured to activate LED 338A based on a control voltage. Although the following discusses LED cell 312A, it should be understood that other LED cells of LED cells 312 may be substantially similar to LED cell 312A. For example, LED cell 312N may include switching element 332N that is similar to switching element 332A, switching element 334N that is similar to switching element 334A, capacitance 336N that is similar to capacitance 336A, and LED 338N that is similar to LED 338A.

Switching element 332A may be configured to control a current at LED 338A to correspond to a control voltage at a gate of switching element 332A. For example, as a gate voltage at switching element 332A increases, a current supplied from voltage source 302 to LED 338A may increase. Similarly, as a gate voltage at switching element 332A decreases, a current supplied from voltage source 302 to LED 338A may decrease. Switching element 332A may be a transistor. For instance, switching element 332A may be an NMOS transistor. In some instances, switching element 332A may be a PMOS transistor.

Switching element 332A may be configured to generate an LED current ("$LED_A$") at LED cell 312A. For example, switching element 332A may generate an LED current output at a source of switching element 332A that increases as a control voltage at a gate of switching element 332A increases. Similarly, switching element 332A may generate the LED current output at the source of switching element 332A that decreases as the control voltage at a gate of switching element 332A decreases.

Switching element 334A may be configured to generate a sense current ("$SENSE_A$") at LED cell 312A. For example, switching element 334A may generate a sense current output at a source of switching element 334A that increases as a current at current reference 334 increases. Similarly, switching element 334A may generate the sense voltage output at the source of switching element 334A that decreases as a current at current reference 334 decreases. Switching element 334A may be a transistor. For instance, switching element 334A may be an NMOS transistor. In some instances, switching element 334A may be a PMOS transistor.

Switching elements 332A and 334A may be matched such that current flowing at one of switching elements 332A and 334A may precisely correspond with current flowing in the other of switching elements 332A and 334A. For example, in response to receiving a particular gate signal, a current flowing at switching element 332A may be 40 times greater than a current flowing at switching element 334A. In this way, a current flowing at switching element 334A may be mirrored, by a scaling factor of K:1, by switching element 332A.

Capacitance 336A may be a parasitic capacitance at a gate of switching element 332A. In some examples, capacitance 336A may include a capacitor. As used herein, a capacitor may include any suitable electrical component configured to store electrical energy in an electric field. For examples, capacitance 336A may include a capacitor. Examples of a capacitor may include, but are not limited to, ceramic capacitors, film capacitors, electrolytic capacitors (e.g., aluminum, tantalum, niobium, or the like), super capacitors (e.g., double layer, pseudocapacitors, hybrid capacitors), mica capacitors, or the like. Although capacitance 336A may be described as a single capacitor, capacitance 336A may include an array of capacitive elements. For instance, capacitance 336A may include an array of capacitive elements coupled in parallel and/or series. In some instances, each capacitive element may be a discrete component, while in other instances, each one of the capacitive elements may be contained within a single package (e.g., capacitor array).

Driver module 306 may include operational amplifier 340, switching element 342, current source 344, and charge pump 346. Although FIG. 3 illustrates switching element 342 as being included in driver module 306, in some examples, switching element 342 may be separate from driver module 306. For instance, switching element 342 may be included in switching modules 310. Charge pump 346 may be configured to increase a voltage supplied by voltage source 302 using capacitors (not shown). As discussed further below, driver module 306 may be configured to drive a control voltage at LED cells 112. Although the following discusses driver module 306 in operation with LED cell 312A, it should be understood driver module 306 may operate similarly with other LED cells of LED cells 312. For example, driver module 306 may be configured to drive a control voltage at LED cell 312N when switching module 310N couples LED cell 312N to driver module 306.

Operational amplifier 340 may include output 350, input 352, and output 354. Operational amplifier 340 may be configured to drive a control voltage at LED cells 312. For example, upon switching module 310A coupling LED cell 312A to driver module 306, operational amplifier 340 may generate a gate voltage ("$GATE_A$") that drives a control voltage at capacitance 336A until a sense voltage ("$SENSE_A$") received at input 352 corresponds to an LED voltage ("$LED_A$") received at input 354.

Switching module 310A may include switching elements 320A, 322A, and 324A. As discussed further below, switching module 310A may be configured to sequentially couple each one of LED cells 312 to driver module 306. Although the following discusses switching module 310A, it should be understood that other switching modules of switching modules 310 may be similar to switching module 310A. For example, switching module 310N may include switching elements 320N, 322N, and 324N that are similar to switching elements 320A, 322A, and 324A, respectively.

Switching modules 310 may be configured to sequentially couple each LED cell of LED cells 312. For example, switching module 312A may activate (e.g., switch-in) switching elements 320A, 322A, and 324A to couple LED cell 312A to driver module 306. Upon operational amplifier 340 driving a control voltage at capacitance 336A, switching module 312A may deactivate (e.g., switch-out) switching elements 320A, 322A, and 324A to decouple LED cell 312A from driver module 306. After switching module 312A decouples LED cell 312A from driver module 306, switching module 312B (not shown) may couple LED cell 312B to driver module 306. Upon operational amplifier 340 driving a control voltage at capacitance at LED cell 312B (not shown), switching module 312B may decouple LED cell 312A from driver module 306. The process to sequentially couple each LED cell of LED cells 312 may repeat until switching module 312N couples LED cell 312N to driver module 306. It should be understood that the above may represent a single programming process. For instance, the above may activate each LED cell of LED cells 312 at a beginning edge of an "on" portion of a duty cycle. As such, circuit 300 may perform a similar process to deactivate each LED cell of LED cells 312 at a beginning edge of an "off" portion of the duty cycle.

Driver module 306 may generate a pulse-width modulation signal to program LED cells 312. For example, driver module 306 may program LED cell 312A 'ON' (e.g., activated) by driving a current at a gate of switching element 334A to correspond to a non-zero reference current. For instance, driver module 306 may program LED cell 312A 'ON' (e.g., activated) by driving a current at a gate of switching element 334A to 52 μA. Similarly, driver module 306 may program LED cell 312A 'OFF' (e.g., deactivated) by driving a current at a gate of switching element 334A to correspond to a zero reference current. Additionally, or alternatively, driver module 306 may program LED cell 312A 'OFF' (e.g., deactivated) by shorting output 350 and input 352 such that the gate of switching element 332 and source of switching element 332 are shorted.

In some examples, driver module 306 may program each one of LED cells 312 with a substantially similar pulse-width modulation signals. For instance, each of LED cells 312A-312N may have a particular duty cycle having a particular duty cycle. However, in other examples, driver module 306 may program each one of LED cells 312 with a pulse-width modulation signal that is independent from pulse-width modulation signals for other LED cells of LED cells 312. For instance, driver module 306 may program LED cell 312A to have a different pulse-width module signal than LED cells 312B-312N.

Figure 4:
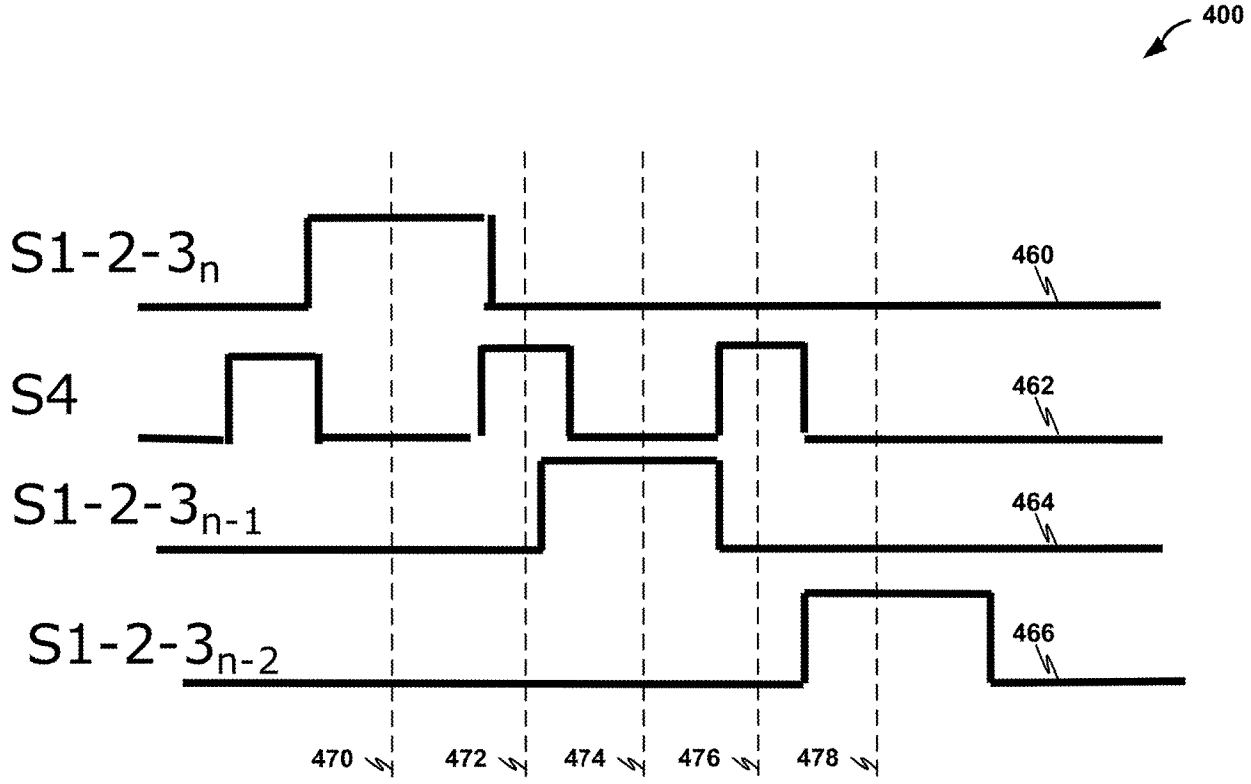
FIG. 4 is an illustration of an example switching signal for sequentially switching, in accordance with one or more techniques of this disclosure.

FIG. 4 is an illustration of an example switching signal 400 for sequentially switching, in accordance with one or more techniques of this disclosure. As shown, switching signal 400 includes switching signals 460, 462, 464, and 466. For example, switching signal 460 may be for activating switching elements 320A, 322A, and 324A of FIG. 3. Switching signal 462 may be for activating switching element 342 of FIG. 3. Switching signal 464 may be for activating switching elements 320B, 322B, and 324B of FIG. 3 (not shown). Switching signal 466 may be for activating switching elements switching elements 320N, 322N, and 324N of FIG. 3. Control module 104 of FIG. 1 may generate switching signals 460, 462, 464, and 466.

During first programming state 470, switching signal 460 activates switching elements 320A, 322A, and 324A of FIG. 3, switching signal 462 deactivates switching element 342 of FIG. 3, switching signal 464 deactivates switching elements 320B, 322B, and 324B of FIG. 3, and switching signal 466 deactivates switching elements 320N, 322N, and 324N of FIG. 3.

During first switching state 472, switching signal 460 deactivates switching elements 320A, 322A, and 324A of FIG. 3, switching signal 462 activates switching element 342 of FIG. 3 to freeze operational amplifier 340 of FIG. 3, switching signal 464 deactivates switching elements 320B, 322B, and 324B of FIG. 3, and third switching signal 466 deactivates switching elements 320N, 322N, and 324N of FIG. 3.

During second programming state 474, switching signal 460 deactivates switching elements 320A, 322A, and 324A of FIG. 3, switching signal 462 deactivates switching element 342 of FIG. 3, switching signal 464 activates switching elements 320B, 322B, and 324B of FIG. 3, and switching signal 466 deactivates switching elements 320N, 322N, and 324N of FIG. 3.

During second switching state 476, switching signal 460 deactivates switching elements 320A, 322A, and 324A of FIG. 3, switching signal 462 activates switching element 342 of FIG. 3 to freeze operational amplifier 340 of FIG. 3, switching signal 464 deactivates switching elements 320B, 322B, and 324B of FIG. 3, and third switching signal 466 deactivates switching elements 320N, 322N, and 324N of FIG. 3.

During third programming state 478, switching signal 460 deactivates switching elements 320A, 322A, and 324A of FIG. 3, switching signal 462 deactivates switching element 342 of FIG. 3, switching signal 464 deactivates switching elements 320B, 322B, and 324B of FIG. 3, and switching signal 466 activates switching elements 320N, 322N, and 324N of FIG. 3.

Figure 5:
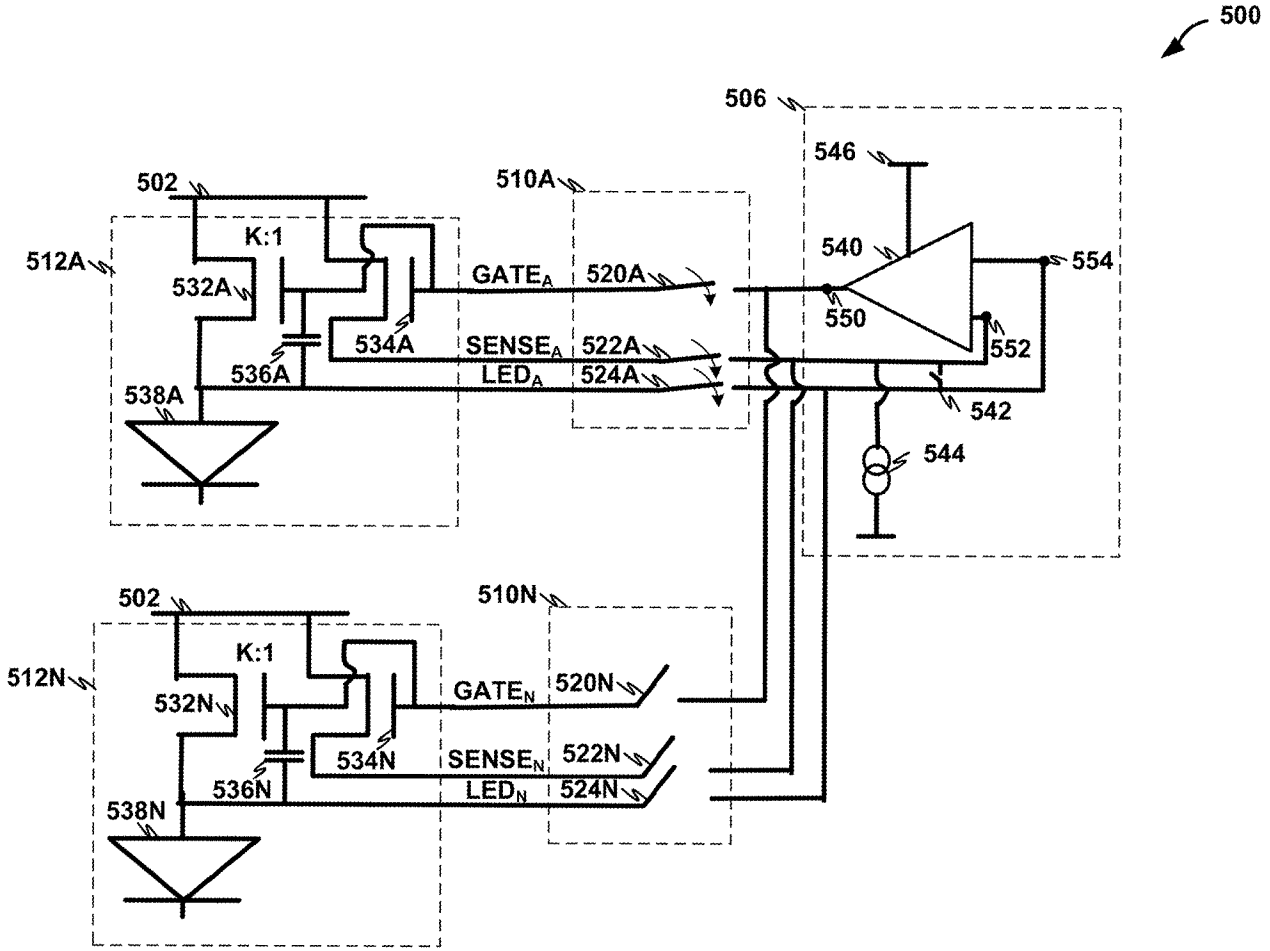
FIG. 5 is an illustration of a first programming state, in accordance with one or more techniques of this disclosure.

FIG. 5 is an illustration of a first programming state, in accordance with one or more techniques of this disclosure. As illustrated, circuit 500 includes voltage source 502, driver module 506, switching modules 510A-510N (collectively, switching modules 510 or switching module 510), and LED cells 512A-512N (collectively, LED cells 512). Voltage source 502 may be an example of voltage source 102 of FIG. 1. Driver module 506 may be an example of driver module 106 of FIG. 1. LED cells 512 may be an example of LED cells 112 of FIG. 1. Switching modules 510 may be an example of switching modules 110 of FIG. 1. Switching modules 510 and/or LED cells 512 may be included in an LED matrix device (not shown).

Driver module 506 may be similar to driver module 306 of FIG. 3. For example, as shown, driver module 506 may include operational amplifier 540 having output 550 and inputs 552 and 554, switching element 542, current source 544, and charge pump 546 that are substantially similar to operational amplifier 340, switching element 342, current source 344, and charge pump 346 of FIG. 3, respectively.

Switching modules 510 may be similar to switching modules 310 of FIG. 3. For example, as shown, switching module 510A may include switching elements 520A, 522A, and 524A that are substantially similar to switching elements 320A, 322A, and 324A of FIG. 3, respectively. Similarly, switching module 510N may include switching elements 520N, 522N, and 524N that are substantially similar to switching elements 320N, 322N, and 324N of FIG. 3, respectively.

LED cells 512 may be similar to LED cells 312 of FIG. 3. For example, as shown, LED cell 512A may include switching element 532A, switching element 534A, capacitance 536A, and LED 538A that are substantially similar to switching element 332A, switching element 334A, capacitance 336A, and LED 338A of FIG. 3, respectively. Similarly, LED cell 512N may include switching element 532N, switching element 534N, capacitance 536N, and LED 538N that are substantially similar to switching element 332N, switching element 334N, capacitance 336N, and LED 338N of FIG. 3, respectively.

During the first programming state of FIG. 5 (e.g., programming state 470 of FIG. 4), switching module 510A couples LED cell 512A to driver module 506. For example, switching element 520A may couple output 550 of operational amplifier 540 to capacitance 536A, switching element 522A may couple input 552 of operational amplifier 540 to a source of switching element 534A, and switching element 524A may couple input 554 of operational amplifier 540 to a source of switching element 532A.

Upon switching module 510A coupling LED cell 512A to driver module 506, operational amplifier 540 may "program" the control voltage at capacitance 536A. For example, at a beginning edge of an "on" portion of a duty cycle, operational amplifier 540 may drive the control voltage at capacitance 536A of LED cell 512A to activate LED 538A at LED cell 512A. More specifically, for example, driver module 506 may drive the control voltage of LED cell 512A based on a reference current. For example, driver module 506 may drive the control voltage of LED cell 512A such that a current at LED 548 corresponds to a reference current generated by current source 544. For instance, driver module 506 may increase a gate voltage ("$GATE_A$") at switching element 332A when a sense voltage ("$SENSE_A$") received at input 552 is greater than an LED voltage ("$LED_A$") received at input 554. Similarly, driver module 506 may decrease a gate voltage ("$GATE_A$") at switching element 332A when a sense voltage ("$SENSE_A$") received at input 552 is less than an LED voltage ("$LED_A$") received at input 554.

Figure 6:
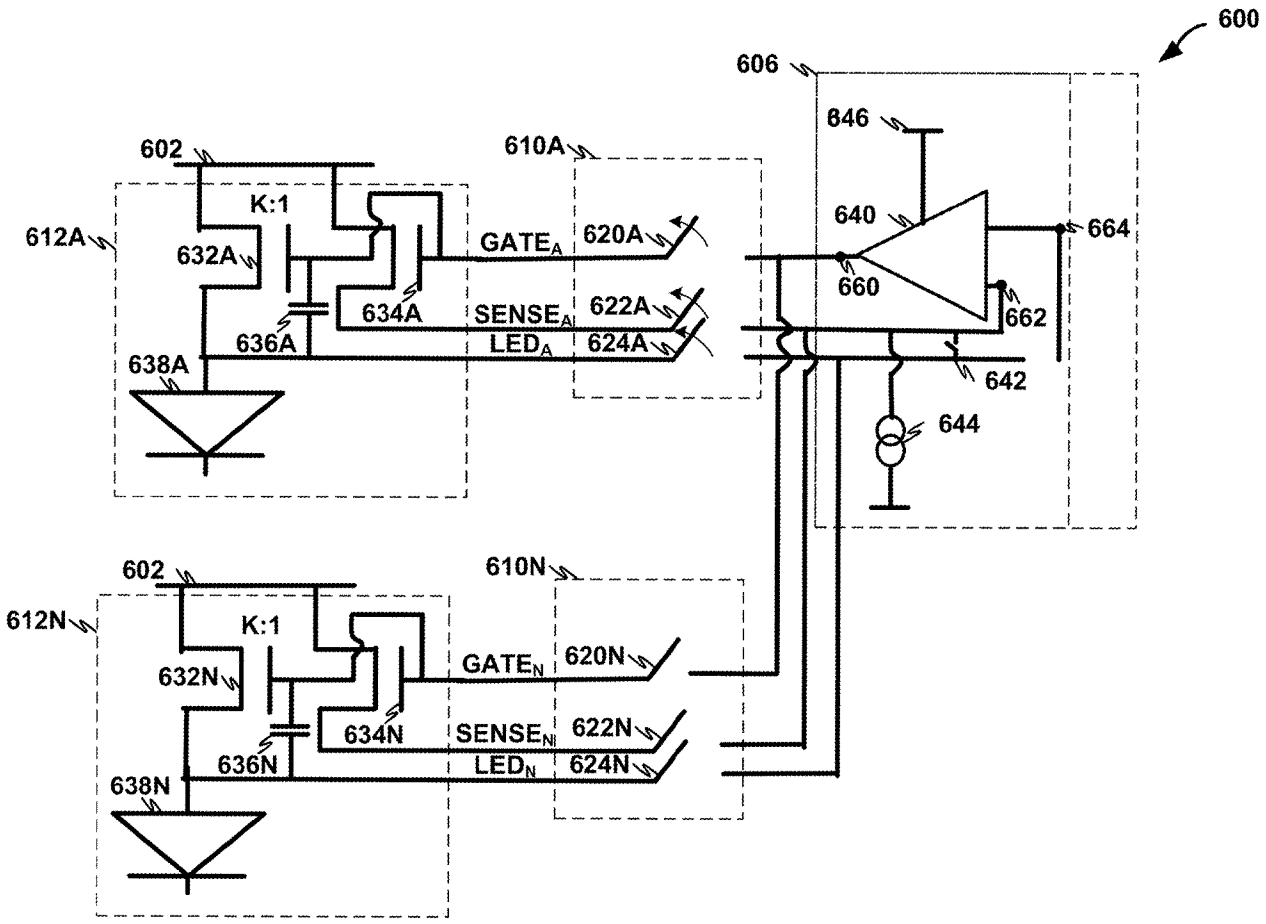
FIG. 6 is an illustration of a switching state, in accordance with one or more techniques of this disclosure.

FIG. 6 is an illustration of a switching state, in accordance with one or more techniques of this disclosure. As illustrated, circuit 600 includes voltage source 602, driver module 606, switching modules 610A-610N (collectively, switching modules 610), and LED cells 612A-612N (collectively, LED cells 612). Voltage source 602 may be an example of voltage source 102 of FIG. 1. Driver module 606 may be an example of driver module 106 of FIG. 1. LED cells 612 may be an example of LED cells 112 of FIG. 1. Switching modules 610 may be an example of switching modules 110 of FIG. 1. Switching modules 610 and/or LED cells 612 may be included in an LED matrix device (not shown).

Driver module 606 may be similar to driver module 306 of FIG. 3. For example, as shown, driver module 606 may include operational amplifier 640 having output 650 and inputs 652 and 654, switching element 642, current source 644, and charge pump 646 that are substantially similar to operational amplifier 340, switching element 342, current source 344, and charge pump 346 of FIG. 3, respectively.

Switching modules 610 may be similar to switching modules 310 of FIG. 3. For example, as shown, switching module 610A may include switching elements 620A, 622A, and 624A that are substantially similar to switching elements 320A, 322A, and 324A of FIG. 3, respectively. Similarly, switching module 610N may include switching elements 620N, 622N, and 624N that are substantially similar to switching elements 320N, 322N, and 324N of FIG. 3, respectively.

LED cells 612 may be similar to LED cells 312 of FIG. 3. For example, as shown, LED cell 612A may include switching element 632A, switching element 634A, capacitance 636A, and LED 638A that are substantially similar to switching element 332A, switching element 334A, capacitance 336A, and LED 338A of FIG. 3, respectively. Similarly, LED cell 612N may include switching element 634N, capacitance 636N, and LED 638N that are substantially similar to switching element 332N, switching element 334N, capacitance 336N, and LED 338N of FIG. 3, respectively. Although shown as a single package, it should be understood that components of LED cells 612 may be formed on different substrates. For example, LED 638A may be formed on a substrate that is different than a substrate that includes switching element 632A, switching element 634A, capacitance 636A.

During the switching state of FIG. 6 (e.g., switching state 472 of FIG. 4), switching modules 610 decouple LED cells 612 from driver module 606. For example, switching element 620A may deactivate to decouple output 650 of operational amplifier 640 from capacitance 636A, switching element 622A may deactivate to decouple input 652 of operational amplifier 640 from a source of switching element 634A, and switching element 624A may deactivate to decouple input 654 of operational amplifier 640 from a source of switching element 632A.

During the switching state of FIG. 6, switching element 642 may couple input 652 of operational amplifier 640 to input 654 of operational amplifier 640. Although FIG. 6 illustrates switching element 642 as being included in driver module 606, in other examples switching element 642 may be separate. For example, switching element 642 may be included in switching modules 610. In any case, driver module 606 may remain at a stable operating point because coupling input 652 to input 654 may cause operational amplifier 640 to maintain gate voltage ("$GATE_A$") generated at output 650.

Figure 7:
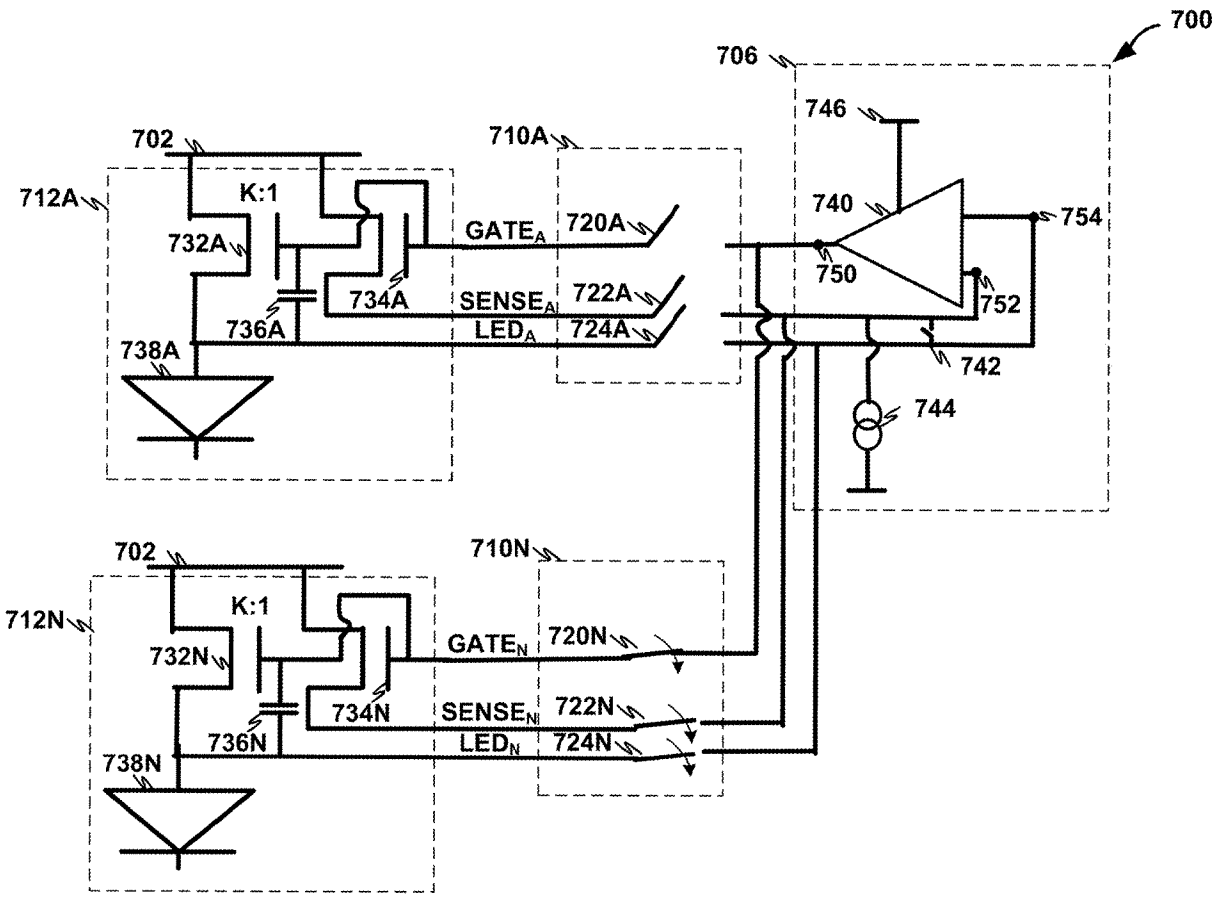
FIG. 7 is an illustration of a second programming state, in accordance with one or more techniques of this disclosure.

FIG. 7 is an illustration of a second programming state, in accordance with one or more techniques of this disclosure. As illustrated, circuit 700 includes voltage source 702, driver module 706, switching modules 710A-710N (collectively, switching modules 710), and LED cells 712A-712N (collectively, LED cells 712). Voltage source 702 may be an example of voltage source 102 of FIG. 1. Driver module 706 may be an example of driver module 106 of FIG. 1. LED cells 712 may be an example of LED cells 112 of FIG. 1. Switching modules 710 may be an example of switching modules 110 of FIG. 1. Switching modules 710 and/or LED cells 712 may be included in an LED matrix device (not shown).

Driver module 706 may be similar to driver module 306 of FIG. 3. For example, as shown, driver module 706 may include operational amplifier 740 having output 750 and inputs 752 and 754, switching element 742, current source 744, and charge pump 746 that are substantially similar to operational amplifier 340, switching element 342, current source 344, and charge pump 346 of FIG. 3, respectively.

Switching modules 710 may be similar to switching modules 310 of FIG. 3. For example, as shown, switching module 710A may include switching elements 720A, 722A, and 724A that are substantially similar to switching elements 320A, 322A, and 324A of FIG. 3, respectively. Similarly, switching module 710N may include switching elements 720N, 722N, and 724N that are substantially similar to switching elements 320N, 322N, and 324N of FIG. 3, respectively.

LED cells 712 may be similar to LED cells 312 of FIG. 3. For example, as shown, LED cell 712A may include switching element 732A, switching element 734A, capacitance 736A, and LED 738A that are substantially similar to switching element 332A, switching element 334A, capacitance 336A, and LED 338A of FIG. 3, respectively. Similarly, LED cell 712N may include switching element 732N, switching element 734N, capacitance 736N, and LED 738N that are substantially similar to switching element 332N, switching element 334N, capacitance 336N, and LED 338N of FIG. 3, respectively. Although shown as a single package, it should be understood that components of LED cells 712 may be formed on different substrates. For example, LED 738A may be formed on a substrate that is different than a substrate that includes switching element 732A, switching element 734A, capacitance 736A.

During the second programming state of FIG. 7 (e.g., programming state 478 of FIG. 4), switching module 710A couples LED cell 712N to driver module 706. For example, switching element 720N may couple output 750 of operational amplifier 740 to capacitance 736N, switching element 722N may couple input 752 of operational amplifier 740 to a source of switching element 734N, and switching element 724N may couple input 754 of operational amplifier 740 to a source of switching element 732N.

Upon switching module 710N coupling LED cell 712N to driver module 706, operational amplifier 740 may "program" the control voltage at capacitance 736N. For example, at a beginning edge of an "on" portion of a duty cycle, operational amplifier 740 may drive the control voltage at capacitance 736N of LED cell 712N to activate LED 738N at LED cell 712N. More specifically, for example, driver module 706 may drive the control voltage of LED cell 712N based on a reference current. For example, driver module 706 may drive the control voltage of LED cell 712N such that a current at LED 748 corresponds to a reference current generated by current source 744. For instance, driver module 706 may increase a gate voltage ("$GATE_N$") at switching element 332N when a sense voltage ("$SENSE_N$") received at input 752 is greater than an LED voltage ("$LED_N$") received at input 754. Similarly, driver module 706 may decrease a gate voltage ("$GATE_N$") at switching element 332N when a sense voltage ("$SENSE_N$") received at input 752 is less than an LED voltage ("$LED_N$") received at input 754.

Figure 8:
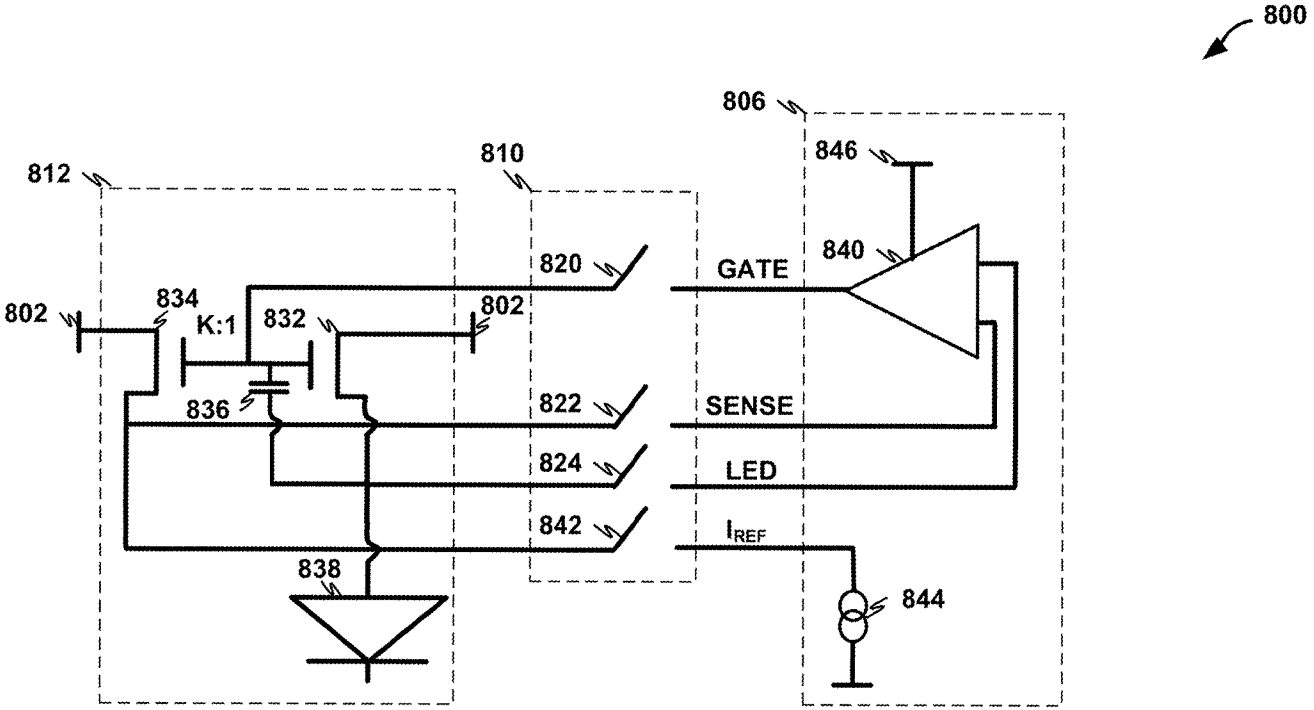
FIG. 8 is a circuit diagram illustrating a second example circuit for bulk LED cell programming, in accordance with one or more techniques of this disclosure.

FIG. 8 is a circuit diagram illustrating a second example circuit 800 for bulk LED cell programming, in accordance with one or more techniques of this disclosure. As illustrated, circuit 800 includes voltage source 802, driver module 806, switching module 810, and LED cell 812. Although FIG. 8 illustrates one LED cell 812, it should be understood that FIG. 8 may include two or more LED cells that are substantially similar to LED cell 812. Additionally, although FIG. 8 illustrates one switching module, it should be understood that FIG. 8 may include two or more switching modules that are substantially similar to switching module 810. Voltage source 802 may be an example of voltage source 102 of FIG. 1. Driver module 806 may be an example of driver module 106 of FIG. 1. LED cell 812 may be an example of LED cell 112A of LED cells 112 of FIG. 1. Switching module 810 may be an example of switching module 110A of switching modules 110 of FIG. 1. Switching module 810 and/or LED cell 812 may be included in an LED matrix device (not shown).

LED cell 812 may be similar to LED cell 312A of FIG. 3. For example, as shown, LED cell 812 may include switching element 832, switching element 834, capacitance 836, and LED 838 that are substantially similar to switching element 332A, switching element 334A, capacitance 336A, and LED 338A of FIG. 3, respectively. Although shown as a single package, it should be understood that components of LED cell 812 may be formed on different substrates. For example, LED 838 may be formed on a substrate that is different than a substrate that includes switching element 832, switching element 834, capacitance 836.

Driver module 806 may be similar to driver module 306 of FIG. 3. For example, as shown, driver module 806 may include operational amplifier 840, current source 844, and charge pump 846 that are substantially similar to operational amplifier 340, current source 344, and charge pump 346 of FIG. 3, respectively. However, as shown, driver module 806 omits a switching element.

Switching module 810 may be similar to switching module 310A of FIG. 3. For example, as shown, switching module 810 may include switching elements 820, 822, and 824 that are substantially similar to switching elements 320A, 322A, and 324A of FIG. 3, respectively. However, as shown, switching module 810 further includes switching element 842.

Switching module 810 may be configured to couple LED cell 812 to driver module 806. More specifically, for example, switching element 842 may be configured to couple current source 844 to a source of switching element 834. Although the following discusses an operation with switching module 810, it should be understood that other switching modules that may be similar to switching module 810. For example, switching module 810 may activate switching elements 820, 822, 824, and 842 to couple LED cell 812 to driver module 806. Upon operational amplifier 840 driving a control voltage at capacitance 836, switching module 810 may deactivate switching elements 820, 822, 824, and 842 to decouple LED cell 812 from driver module 806. After switching module 810 decouples LED cell 812 from driver module 806, another switching module (not shown) may couple another LED cell (not shown) to driver module 806. As such, circuit 800 may program LED cells substantially similar to circuit 300 of FIG. 3.

Figure 9:
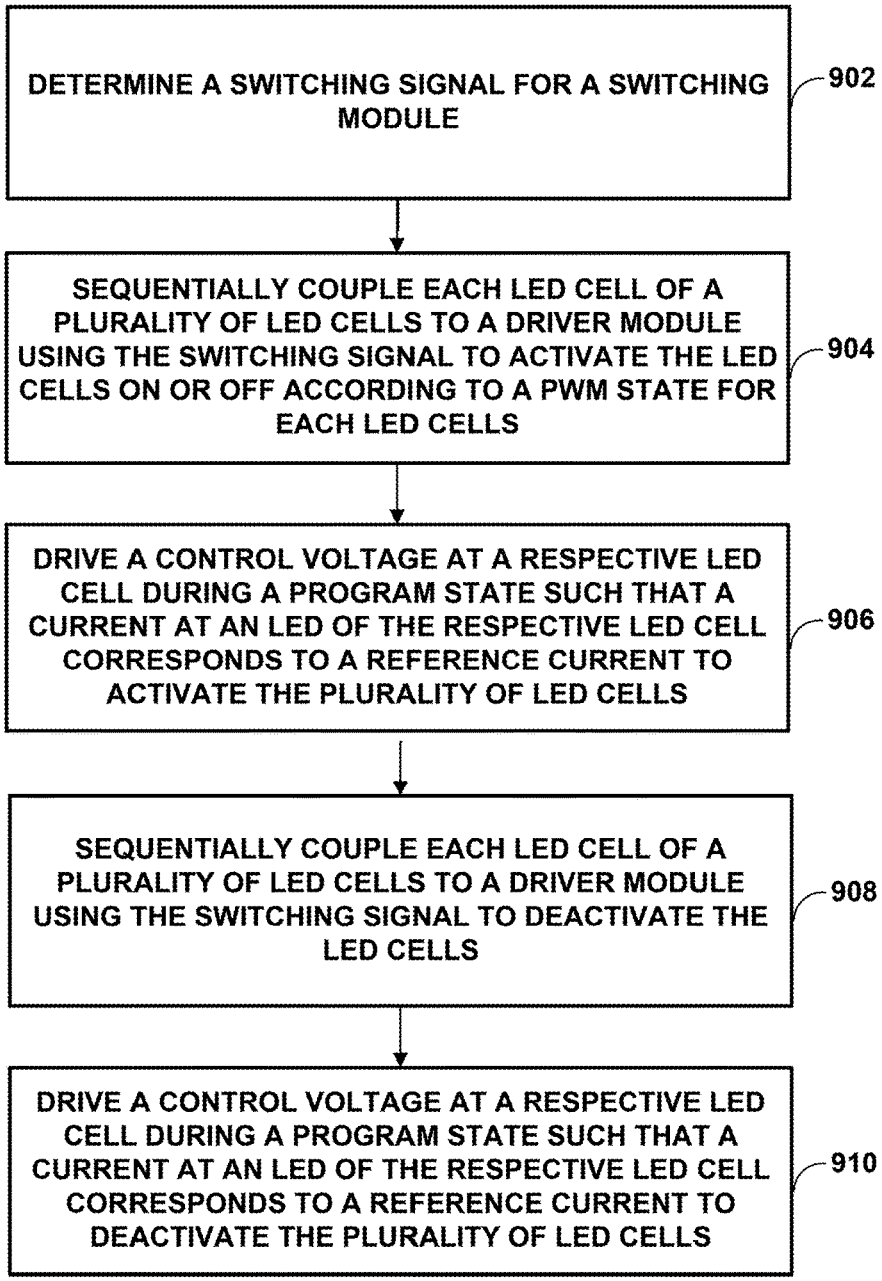
FIG. 9 is a flow diagram for bulk LED cell programming that may be performed by a circuit in accordance with this disclosure.

FIG. 9 is a flow diagram for bulk LED cell programming that may be performed by a circuit in accordance with this disclosure. For purposes of illustration only, the example operations are described below within the context of system 100 of FIG. 1, LED matrix device 208 of FIG. 2, circuit 300 of FIG. 3, switching signal 400 of FIG. 4, circuit 500 of FIG. 5, circuit 600 of FIG. 6, and circuit 700 of FIG. 7. However, the techniques described below can be used in any permutation, and in any combination, with voltage source 102, control module 104, driver module 106, and an LED matrix device 108.

In accordance with one or more techniques of this disclosure, control module 104 determines a switching signal for switching modules 110 (902). For example, control module 104 generates switching signal 400 of FIG. 4. In some examples, control module 104 determines a first switching signal for switching modules 110A having a first pulse-width modulation signal. In this example, control module 104 determines a second switching signal for switching modules 110A having a second pulse-width modulation signal that is different that the first pulse-width modulation signal.

Switching modules 110 sequentially couple each LED cell of LED cells 112 to driver module 106 using the switching signal to activate the LED cells 112 ON or OFF according to a pulse-width modulation signal state for each one of the LED cells 112 (904). For example, during a first programming state, switching module 110A couples LED cell 112A to driver module 106. After the first programming state, switching module 110A decouples LED cell 112A from driver module 106. During a second programming state, switching module 110A couples LED cell 112B to driver module 106, and so on until an 'n' number programming state where switching module 110N couples LED cell 112N to driver module 106.

Although not shown, switching modules 110 may couple inputs at driver module 106 during a switching state. For example, switching element 342 of FIG. 3 couples inputs 352 and 354 during each switching state between programming states.

Driver module 106 drives a control voltage at a respective LED cell during a program state such that a current at an LED of the respective LED cell corresponds to a reference current to activate the plurality of LED cells (906). For example, driver module 106 drives a control voltage at LED cell 112A during a first programming state to activate LED cell 112A. More specifically, at a beginning edge of an "on" portion of a duty cycle, driver module 106 may drive a control voltage at LED cell 112A to activate an LED at LED cell 112A. After driver module 106 drives the control voltage to activate the LED, a capacitance (e.g., parasitic, capacitor unit, etc.) maintains the control voltage to activate the LED at LED cell 112A during the "on" portion of the duty cycle. Upon driving the control voltage at LED cell 112A, driver module 106 drives a control voltage at LED cell 112B during a second programming state to activate LED cell 112B, on so on such until driver module 106 drives a control voltage at LED cell 112N to activate LED cell 112N during an 'n' number programming state.

Switching modules 110 sequentially couple each LED cell of LED cells 112 to driver module 106 using the switching signal to deactivate the LED cells 112 (908). For example, during a first programming state, switching module 110A couples LED cell 112A to driver module 106. After the first programming state, switching module 110A decouples LED cell 112A from driver module 106. During a second programming state, switching module 110A couples LED cell 112B to driver module 106, and so on until an 'n' number programming state where switching module 110N couples LED cell 112N to driver module 106.

Although not shown, switching modules 110 may couple inputs at driver module 106 during a switching state. For example, switching element 342 of FIG. 3 couples inputs 352 and 354 during each switching state between programming states.

Driver module 106 drives a control voltage at a respective LED cell during a program state such that a current at an LED of the respective LED cell corresponds to a reference current to deactivate the plurality of LED cells (910). For example, driver module 106 drives a control voltage at LED cell 112A during a first programming state to deactivate LED cell 112A. More specifically, at an end edge of the "on" portion of the duty cycle, driver module 106 may drive the control voltage at LED cell 112A to deactivate an LED at LED cell 112A. After driver module 106 drives the control voltage to deactivate the LED, the capacitance (e.g., parasitic, capacitor unit, etc.) maintains the control voltage to deactivate the LED at LED cell 112A during the "off" portion of the duty cycle. Upon driving the control voltage at LED cell 112A, driver module 106 drives a control voltage at LED cell 112B during a second programming state to deactivate LED cell 112B, on so on such until driver module 106 drives a control voltage at LED cell 112N to deactivate LED cell 112N during an 'n' number programming state.

Figure 10:
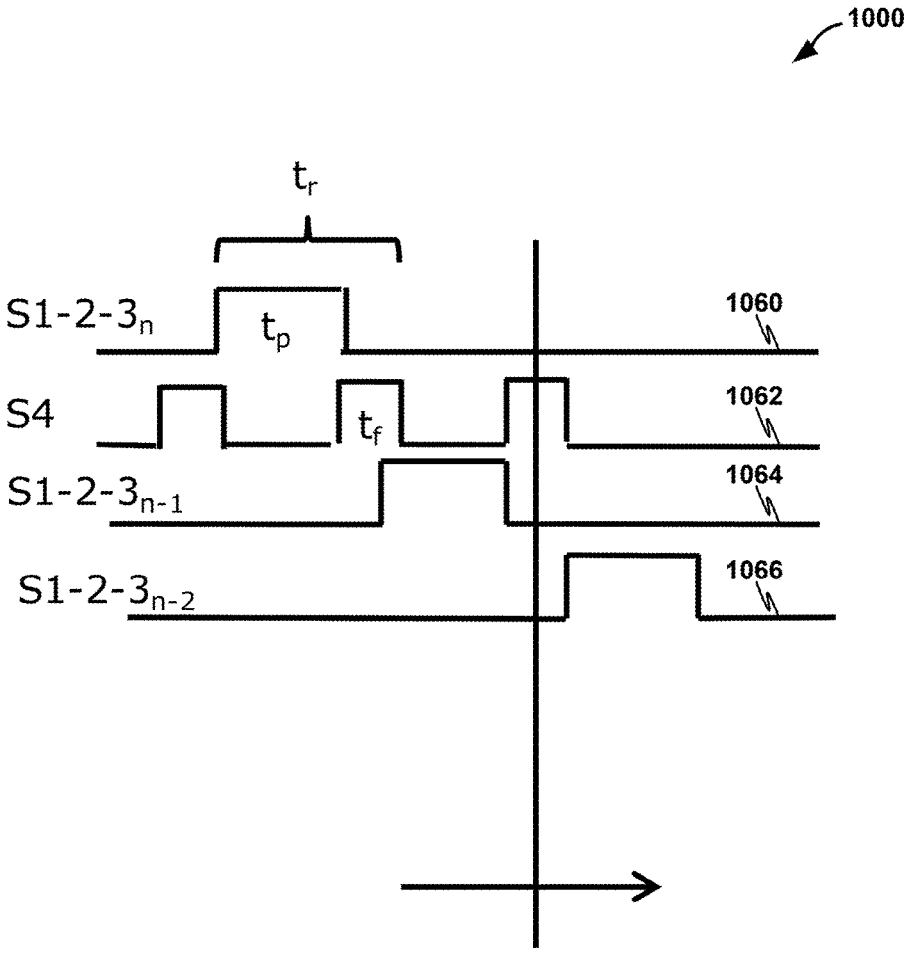
FIG. 10 is an illustration of an example program time for a switching signal for bulk LED cell programming, in accordance with one or more techniques of this disclosure.

FIG. 10 is an illustration of an example program time for a switching signal for bulk LED cell programming, in accordance with one or more techniques of this disclosure. As shown, switching signal 1000 includes switching signals 1060, 1062, 1064, and 1066. For example, switching signal 1060 may be for activating switching elements 320A, 322A, and 324A of FIG. 3. Switching signal 1062 may be for activating switching element 342 of FIG. 3. Switching signal 1064 may be for activating switching elements 320B, 322B, and 324B of FIG. 3 (not shown). Switching signal 1066 may be for activating switching elements switching elements 320N, 322N, and 324N of FIG. 3. Control module 104 of FIG. 1 may generate switching signals 1060, 1062, 1064, and 1066.

In the example of FIG. 10, a total scan time for sequentially switching LED cells 312 of FIG. 3 may be calculated as program time ($t_p$)+freeze time ($t_f$) multiplied by number (n) of rows included in an LED matrix device. In order to permit programming for a particular duty cycle, control module 104 may generate switching signal 1000 such that the total scan time (e.g., program time ($t_p$)+freeze time ($t_f$) multiplied by number (n) of rows included in an LED matrix device) is less than the minimum duty cycle ($t_p+t_f=t_r$) $t_r \times n > t_{DC(min)}$.

The following examples may illustrate one or more aspects of the disclosure.

Example 1. A method comprising: sequentially coupling, by a switching module of a circuit, each cell of the plurality of cells to a driver module, each cell of the plurality of cells comprising a light emitting diode (LED) being configured to activate based on a control voltage at a respective cell; and driving, by the driver module, the control voltage of a respective cell of the plurality of cells based on a reference current when the switching module sequentially couples a respective cell of the plurality of cells to the driver module.

Example 2. The method of example 1, wherein driving the control voltage of the respective cell comprises: driving the control voltage at the respective cell such that a current at the LED of the respective cell corresponds to the reference current.

Example 3. The method of any combination of examples 1-2, wherein the supply circuit comprises an operational amplifier and wherein sequentially coupling each cell of the plurality of cells to the driver module comprises: coupling the operational amplifier to each cell of the plurality of cells during a program state of the circuit; and decoupling the operational amplifier from each cell of the plurality of cells during a switching state of the circuit.

Example 4. The method of any combination of examples 1-3, wherein the operational amplifier includes an output, a first input, and a second input and wherein sequentially coupling each cell of the plurality of cells to the driver module comprises: coupling the output, the first input, and the second input to a respective cell of the plurality of cells during the program state of the circuit.

Example 5. The method of any combination of examples 1-4, wherein sequentially coupling each cell of the plurality of cells to the driver module comprises: coupling the first input to the second input during the switching state of the circuit.

Example 6. The method of any combination of examples 1-5, wherein sequentially coupling each cell of the plurality of cells to the driver module comprises: coupling a current source configured to generate the reference current to each cell of the plurality of cells during the program state of the circuit.

Example 7. The method of any combination of examples 1-6, wherein: each cell of the plurality of cells includes a switching element; the switching element of a respective cell includes at least a gate having a parasitic capacitance; and the control voltage of the respective cell is at the gate of the switching element of the respective cell.

Example 8. The method of any combination of examples 1-7, wherein: each cell of the plurality of cells includes a switching element having at least a gate; each cell of the plurality of cells includes a capacitor coupled to the gate of the switching element of a respective cell; and the control voltage of the respective cell is at the capacitor.

Example 9. The method of any combination of examples 1-8, wherein the plurality of cells is a first plurality of cells, the switching module is a first switching module, the driver module is a first driver module, and the reference current is a first reference current, and the first plurality of cells are arranged in a first row of an LED matrix device, the method further comprising: sequentially coupling, by a second switching module of the circuit, each cell of a second plurality of cells to a second driver module, each cell of second the plurality of cells comprising an LED being configured to activate based on a control voltage at a respective cell, and the second plurality of cells being arranged in a second row of the LED matrix device; and driving, by the second driver module, the control voltage of a respective cell of the second plurality of cells based on the a second reference current when the second switching module sequentially couples a respective cell of the second plurality of cells to the driver module.

Example 10. A circuit comprising: a driver module configured to receive a reference current for a plurality of cells, each cell of the plurality of cells comprising a light emitting diode (LED) configured to activate based on a control voltage at a respective cell of the plurality of cells; and a switching module configured to sequentially couple each cell of the plurality of cells to the driver module, wherein the driver module is further configured to drive a control voltage of a respective cell of the plurality of cells based on the reference current when the switching module sequentially couples a respective cell of the plurality of cells to the driver module.

Example 11. The circuit of example 10, wherein, to drive the control voltage of the respective cell, the driver module is further configured to: drive the control voltage at the respective cell such that a current at the LED of the respective cell corresponds to the reference current.

Example 12. The circuit of any combination of examples 10-11, wherein the supply circuit comprises an operational amplifier and wherein, to sequentially couple each cell of the plurality of cells to the driver module, the switching module is configured to: couple the operational amplifier to each cell of the plurality of cells during a program state of the circuit; and decouple the operational amplifier from each cell of the plurality of cells during a switching state of the circuit.

Example 13. The circuit of any combination of examples 10-12, wherein the operational amplifier includes an output, a first input, and a second input and wherein, to sequentially couple each cell of the plurality of cells to the driver module, the switching module is configured to: couple the output, the first input, and the second input to a respective cell of the plurality of cells during the program state of the circuit.

Example 14. The circuit of any combination of examples 10-13, wherein, to sequentially couple each cell of the plurality of cells to the driver module, the switching module is configured to: couple the first input to the second input during the switching state of the circuit.

Example 15. The circuit of any combination of examples 10-14, wherein, to sequentially couple each cell of the plurality of cells to the driver module, the switching module is configured to: couple a current source configured to generate the reference current to each cell of the plurality of cells during the program state of the circuit.

Example 16. The circuit of any combination of examples 10-15, further comprising: the plurality of cells, each cell of the plurality of cells including a switching element, the switching element including at least a gate having a parasitic capacitance, wherein the control voltage of the respective cell is at the gate of the switching element of the respective cell.

Example 17. The circuit of any combination of examples 10-16, further comprising: the plurality of cells, each cell of the plurality of cells including a switching element having at least a gate, and each cell of the plurality of cells including a capacitor coupled to a gate of a switching element of the respective cell, wherein the control voltage of the respective cell is at the capacitor of the respective cell.

Example 18. The circuit of any combination of examples 10-17, wherein the plurality of cells is a first plurality of cells, the switching module is a first switching module, the driver module is a first driver module, the reference current is a first reference current, and the first plurality of cells are arranged in a first row of an LED matrix device, the circuit further comprising: a second driver module configured to receive a second reference current for a second plurality of cells, each cell of the second plurality of cells comprising an LED configured to activate based on a control voltage at a respective cell of the second plurality of cells, and the second plurality of cells being arranged in a second row of the LED matrix device; and a second switching module configured to sequentially couple each cell of the second plurality of cells to the second driver module, wherein the second driver module is further configured to drive a control voltage of a respective cell of the second plurality of cells based on the second reference current when the second switching module sequentially couples a respective cell of the second plurality of cells to the second driver module.

Example 19. A circuit comprising: a light emitting diode (LED) matrix device comprising at least a plurality of cells arranged in a row of the LED matrix device, each cell of the plurality of cells comprising an LED configured to activate based on a control voltage at a respective cell of the plurality of cells; a driver module configured to receive a reference current for the plurality of cells; and a switching module configured to sequentially couple each cell of the plurality of cells to the driver module, wherein the driver module is further configured to drive a control voltage of a respective cell of the plurality of cells based on the reference current when the switching module sequentially couples a respective cell of the plurality of cells to the driver module.

Example 20. The circuit of example 19, wherein the plurality of cells is a first plurality of cells, the row of the LED matrix device is a first row of the LED matrix device, the switching module is a first switching module, the driver module is a first driver module, and the reference current is a first reference current, the circuit further comprising: a second driver module configured to receive a second reference current for a second plurality of cells arranged in a second row of the LED matrix device, each cell of the second plurality of cells comprising an LED configured to activate based on a control voltage at a respective cell of the second plurality of cells; and a second switching module configured to sequentially couple each cell of the second plurality of cells to the second driver module, wherein the second driver module is further configured to drive a control voltage of a respective cell of the second plurality of cells based on the second reference current when the second switching module sequentially couples a respective cell of the second plurality of cells to the second driver module.

Various aspects have been described in this disclosure. These and other aspects are within the scope of the following claims.

The invention claimed is:

1. A method comprising:

sequentially coupling, by a switching module of a circuit, each cell of a plurality of cells to a driver module, each cell of the plurality of cells comprising a light emitting diode (LED) being configured to activate based on a control voltage at a respective cell of the plurality of cells; and driving, by the driver module, the control voltage of the respective cell based on a reference current when the switching module sequentially couples the respective cell to the driver module, wherein the driver module comprises an operational amplifier that includes an output, a first input, and a second input and wherein sequentially coupling each cell of the plurality of cells to the driver module comprises:

coupling the output, the first input, and the second input to the respective cell during a program state of the circuit; and decoupling the output, the first input, and the second input from each cell of the plurality of cells during a switching state of the circuit.

2. The method of claim 1, wherein driving the control voltage of the respective cell comprises:

driving the control voltage at the respective cell such that a current at the LED of the respective cell corresponds to the reference current.

3. The method of claim 1, wherein sequentially coupling each cell of the plurality of cells to the driver module comprises:

coupling the first input to the second input during the switching state of the circuit.

4. The method of claim 1, wherein sequentially coupling each cell of the plurality of cells to the driver module comprises:

coupling a current source configured to generate the reference current to the respective cell during the program state of the circuit.

5. The method of claim 1, wherein:

each cell of the plurality of cells includes a switching element;

the switching element of the respective cell includes at least a gate having a parasitic capacitance; and the control voltage of the respective cell is at the gate of the switching element of the respective cell.

6. The method of claim 1, wherein:

each cell of the plurality of cells includes a switching element having at least a gate;

each cell of the plurality of cells includes a capacitor coupled to the gate of the switching element of a respective cell; and the control voltage of the respective cell is at the capacitor.

7. The method of claim 1, wherein the plurality of cells is a first plurality of cells, the switching module is a first switching module, the driver module is a first driver module, and the reference current is a first reference current, and the first plurality of cells are arranged in a first column of an LED matrix device, the method further comprising:

sequentially coupling, by a second switching module of the circuit, each cell of a second plurality of cells to a second driver module, each cell of the second plurality of cells comprising an LED being configured to activate based on a control voltage at a respective cell of the second plurality of cells, and the second plurality of cells being arranged in a second column of the LED matrix device; and driving, by the second driver module, the control voltage of the respective cell of the second plurality of cells based on the a second reference current when the second switching module sequentially couples a respective cell of the second plurality of cells to the driver module.

8. A circuit comprising:

a driver module configured to receive a reference current for a plurality of cells, each cell of the plurality of cells comprising a light emitting diode (LED) configured to activate based on a control voltage at a respective cell of the plurality of cells, wherein the driver module comprises an operational amplifier that includes an output, a first input, and a second input; and a switching module configured to sequentially couple each cell of the plurality of cells to the driver module, wherein, to sequentially couple each cell of the plurality of cells to the driver module, the switching module is configured to:

couple the output, the first input, and the second input to the respective cell during a program state of the circuit; and decouple the output, the first input, and the second input from each cell of the plurality of cells during a switching state of the circuit, wherein the driver module is further configured to drive the control voltage of the respective cell based on the reference current when the switching module sequentially couples the respective cell to the driver module.

9. The circuit of claim 8, wherein, to drive the control voltage of the respective cell, the driver module is further configured to:

drive the control voltage at the respective cell such that a current at the LED of the respective cell corresponds to the reference current.

10. The circuit of claim 8, wherein, to sequentially couple each cell of the plurality of cells to the driver module, the switching module is configured to:

couple the first input to the second input during the switching state of the circuit.

11. The circuit of claim 8, wherein, to sequentially couple each cell of the plurality of cells to the driver module, the switching module is configured to:

couple a current source configured to generate the reference current to the respective cell during the program state of the circuit.

12. The circuit of claim 8, further comprising:

the plurality of cells, each cell of the plurality of cells including a switching element, the switching element including at least a gate having a parasitic capacitance, wherein the control voltage of the respective cell is at the gate of the switching element of the respective cell.

13. The circuit of claim 8, further comprising:

the plurality of cells, each cell of the plurality of cells including a switching element having at least a gate, and each cell of the plurality of cells including a capacitor coupled to a gate of a switching element of the respective cell, wherein the control voltage of the respective cell is at the capacitor of the respective cell.

14. The circuit of claim 8, wherein the plurality of cells is a first plurality of cells, the switching module is a first switching module, the driver module is a first driver module, the reference current is a first reference current, and the first plurality of cells are arranged in a first column of an LED matrix device, the circuit further comprising:

a second driver module configured to receive a second reference current for a second plurality of cells, each cell of the second plurality of cells comprising an LED configured to activate based on a control voltage at a respective cell of the second plurality of cells, and the second plurality of cells being arranged in a second column of the LED matrix device; and a second switching module configured to sequentially couple each cell of the second plurality of cells to the second driver module, wherein the second driver module is further configured to drive the control voltage of the respective cell of the second plurality of cells based on the second reference current when the second switching module sequentially couples the respective cell of the second plurality of cells to the second driver module.

15. A circuit comprising:

a light emitting diode (LED) matrix device comprising at least a plurality of cells arranged in a column of the LED matrix device, each cell of the plurality of cells comprising an LED configured to activate based on a control voltage at a respective cell of the plurality of cells;

a driver module configured to receive a reference current for the plurality of cells, wherein the driver module comprises an operational amplifier that includes an output, a first input, and a second input; and a switching module configured to sequentially couple each cell of the plurality of cells to the driver module, wherein, to sequentially couple each cell of the plurality of cells to the driver module, the switching module is configured to:

couple the output, the first input, and the second input to the respective cell during a program state of the circuit; and decouple the output, the first input, and the second input from each cell of the plurality of cells during a switching state of the circuit, wherein the driver module is further configured to drive the control voltage of the respective cell based on the reference current when the switching module sequentially couples the respective cell to the driver module.

16. The circuit of claim 15, wherein the plurality of cells is a first plurality of cells, the column of the LED matrix device is a first column of the LED matrix device, the switching module is a first switching module, the driver module is a first driver module, and the reference current is a first reference current, the circuit further comprising:

a second driver module configured to receive a second reference current for a second plurality of cells arranged in a second column of the LED matrix device, each cell of the second plurality of cells comprising an LED configured to activate based on a control voltage at a respective cell of the second plurality of cells; and a second switching module configured to sequentially couple each cell of the second plurality of cells to the second driver module, wherein the second driver module is further configured to drive the control voltage of the respective cell of the second plurality of cells based on the second reference current when the second switching module sequentially couples the respective cell of the second plurality of cells to the second driver module.

* * * * *